United States Patent [19]

DiVito

[11] 4,361,282

[45] Nov. 30, 1982

[54] PULSATING NOZZLE

[76] Inventor: Angelo DiVito, 1354 S. Belvoir Blvd., South Euclid, Ohio 44121

[21] Appl. No.: 238,019

[22] Filed: Feb. 25, 1981

[51] Int. Cl.[3] ..... B05B 1/34

[52] U.S. Cl. ..... 239/383; 134/22.12; 134/167 C; 239/DIG. 13

[58] Field of Search ..... 239/380, 381, 382, 383, 239/DIG. 13; 134/166 C, 167 C, 168 C, 169 C, 172, 176, 179, 198, 22.11, 22.12

[56] References Cited

U.S. PATENT DOCUMENTS

| | | | |
|---|---|---|---|
| 2,035,194 | 3/1936 | Schellin | 239/383 |
| 2,818,076 | 12/1957 | Erling | 134/169 C |
| 3,473,736 | 10/1969 | Heitzman | 239/383 |
| 3,814,330 | 6/1974 | Masters | 239/DIG. 13 |

FOREIGN PATENT DOCUMENTS

| | | | |
|---|---|---|---|
| 2755893 | 6/1979 | Fed. Rep. of Germany | 239/383 |

*Primary Examiner*—Robert B. Reeves
*Assistant Examiner*—Michael J. Forman

[57] ABSTRACT

A pulsating fluid nozzle is disclosed which comprises a body having an inner chamber and an outer chamber separated by a cylindrical wall. The inner chamber is supplied with fluid through a fluid outlet, and the outer chamber supplies fluid to the fluid outlets. The cylindrical wall has a port through which fluid can flow from the inner chamber to the outer chamber. A rotor is mounted for rotation in the outer chamber. The rotor has a blade extending from an annular hub which is adapted to fit around the cylindrical wall and block the flow of fluid through the port. The hub has an opening adapted to intermittently coincide with the port as the rotor turns to permit the flow of fluid through the port to produce a pulsating flow. The blade is adjacent to the opening and positioned to be contacted by a stream of fluid flowing through the port when the opening coincides with the port. The contact by the stream of fluid propels the blade to turn the rotor. The nozzle produces a pulsating flow without using a special pulsating pump, and can utilize the full maximum flow of fluid through the flexible hose connected to the fluid inlet of the nozzle.

7 Claims, 7 Drawing Figures

PULSATING NOZZLE

BACKGROUND OF THE INVENTION

1. Field of the Invention

This invention relates to a nozzle or head of the type mounted on the ends of flexible hoses and used for the cleaning of pipes, ducts and waste water conduits using high velocity streams of liquid, and more particularly to such a nozzle which produces a pulsating flow.

2. Description of the Prior Art

Waste conduits containing caked or loosely adherent sludge, sediment, stone and other solid articles have been cleaned with the aid of a self-propelled nozzle or head affixed to the end of a flexible hose and having a plurality of rearwardly directed jets of high velocity fluid, usually water. In these systems, the reaction force upon the nozzle propels it through the conduit while entraining the attached length of flexible hose therealong. The fluid jets concurrently loosen adherent materials and carry them back through the conduit. When the nozzle is retracted in the direction of the advance of the nozzle by drawing upon the hose or a cable affixed to the nozzle, the rearwardly directed streams of fluid act to scoop sediment and contaminants away from the walls of the waste conduit and thereby provide an additional loosening and cleansing effect. Examples of prior art self-propelled nozzles are shown in U.S. Pat. Nos. 1,176,518 issued to Burns, 1,628,070 issued to Sladden, 3,080,265 issued to Maasberg, and 3,321,184, issued to Goss.

The flow rate of fluid emitted by the nozzle and the pressure of the fluid are limited by the output of the pump supplying fluid to the nozzle and the capacity of the flexible hose which connects the pump to the nozzle. The pressure and flow rate of the fluid are regulated in the nozzle by the size and number of the jets or orifices in the nozzle through which the fluid flows. With the pump producing a maximum flow rate at maximum pressure of the pump outlet, the pressure and flow rate of fluid through the nozzle are limited by the capacities of the pump and the connecting hose.

While the cleaning effect produced by these prior art nozzles has been sufficient where the degree of sedimentation is not excessive and where the walls of the conduit are coated with a loosely adherent layer of sludge, these nozzles have encountered difficulty in removing heavy accumulations of adherent sludge or caked-on material even when the water dispensed by the nozzle is at high velocity with the maximum pressure and volume possible.

It has been proposed to produce a pulsating jet of fluid from the nozzle in order to increase the effectiveness of the nozzle in removing caked sludge from the walls of the conduit. Such a pulsating jet has been produced by using a pump which produces a pulsating flow of fluid through the flexible hose to the nozzle. This pulsating system requires a specially adapted pump which can be quite expensive. In addition, the effectiveness of this pulsating system has been limited by the capacity of the pump and the capacity of the flexible hose to carry a given maximum rate of fluid through the hose from the pump to the nozzle. Thus, when the pulsating flow from the pump reaches its maximum flow rate, this maximum flow rate cannot be any greater than the maximum flow rate produced by a continuous flow because it reaches the maximum capacity of the hose. The effectiveness of this pulsating spray is, therefore, not much greater than a continuous spray. Another problem with this pulsating system is that the pump is often a considerable distance away from the nozzle and this pulsating flow produced by the pump loses some of its effectiveness as the fluid travels through the flexible hose to the nozzle.

SUMMARY OF THE INVENTION

The present invention provides an improved nozzle for the cleaning of waste conduits which avoids the difficulties of the prior art. The present invention provides a pulsating nozzle which produces a pulsating jet spray to clean waste conduits more effectively than the continuous sprays produced by conventional nozzles. The improved pulsating nozzle of the present invention dislodges sediment, sludge and other contaminants from heavily obstructed waste conduits in which fluid utilization and the rate of cleaning are sharply increased by comparison with the conventional nozzles.

The nozzle of the present invention produces a pulsating flow through the use of a mechanism within the nozzle which operates using the continuous flow of fluid through the nozzle. The pulsating mechanism within the nozzle is relatively simple in operation and produces a pulsating fluid flow to the spray jets automatically as fluid flows through the nozzle. With the nozzle of the present invention, it is not necessary to use a particular pulsating pump or any other specialized apparatus. The nozzle of the present invention may be connected to any suitable pump and flexible hose such as those conventionally used in cleaning waste conduits to produce a pulsating jet spray to increase the effectiveness of the apparatus.

The maximum flow rate output through the jets of the nozzle of the present invention may be periodically greater than the maximum flow rate through the hose connecting the nozzle to the pump because the nozzle of the present invention includes a small reservoir within the nozzle in which fluid is maintained to supply the maximum demands of the jet during its pulsating cycle. Thus, the nozzle of the present invention may produce periodic maximum flow rates greater than those of other nozzles while using the same pump and the same diameter hose to connect the nozzle.

These and other advantages are provided by the present invention of a pulsating fluid nozzle which comprises a body having an inner chamber and an outer chamber extending around the inner chamber. The inner chamber is separated from the outer chamber by a cylindrical wall. The body also has a fluid inlet connected to supply fluid to the inner chamber and a fluid outlet connected to receive fluid from the outer chamber. The cylindrical wall has a port through which fluid can flow from the inner chamber to the outer chamber. A rotor is mounted for rotation in the outer chamber. The rotor has a blade extending from an annular hub. The hub is adapted to fit around the cylindrical wall and block the flow of fluid through the port in the wall. The hub has an opening adapted to intermittently coincide with the port in the wall as the rotor turns to intermittently permit the flow of fluid through the port to produce a pulsating flow. The blade is adjacent to the opening and positioned to be contacted by the stream of fluid flowing through the port when the opening coincides with the port. The contact by the stream of fluid propels the blade to turn the rotor.

Preferably, the cylindrical wall has a plurality of ports, the rotor has a plurality of blades extending from the annular hub, and the hub has a plurality of openings adapted to intermittently coincide with the ports in the wall as the rotor turns. Each blade is adjacent to one of the openings and is positioned to be contacted by a stream of fluid flowing through one of the ports when the adjacent opening coincides with one of the ports.

In addition, each port preferably extends in a direction generally parallel to the radius of the cylindrical wall and laterally offset from the radius. When the stream of water flows through each port, one of the blades of the rotor preferably extends perpendicularly to the stream of water to absorb the maximum amount of impulse from the stream.

DETAILED DESCRIPTION OF THE PREFERRED EMBODIMENTS

Figure 2:
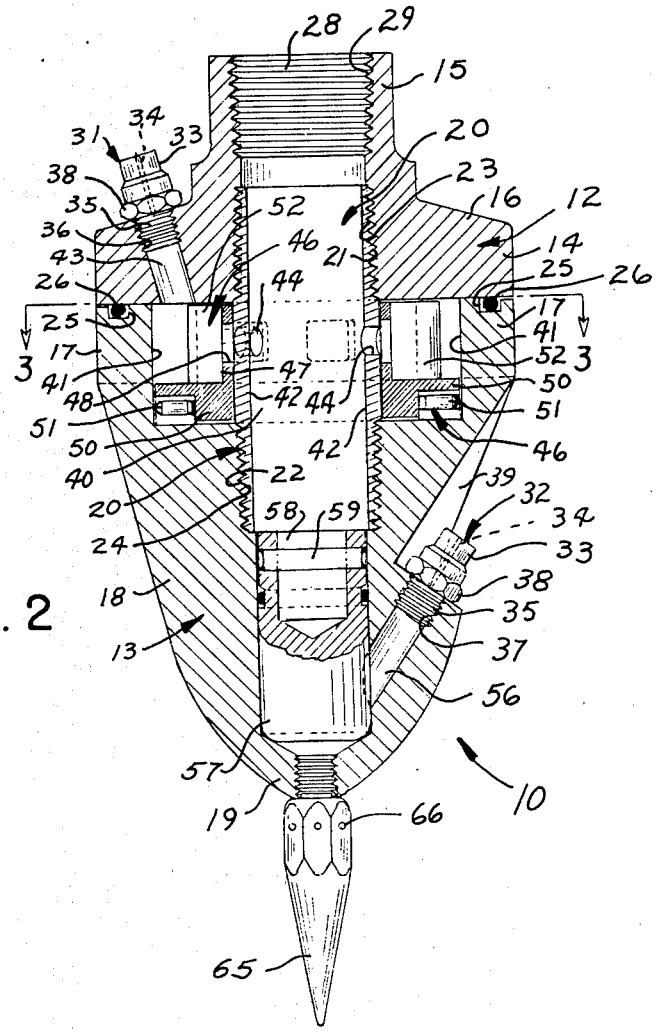
FIG. 2 is a side sectional view of the nozzle taken along line 2—2 of FIG. 1.

Referring more particularly to the drawings, and initially to FIG. 2, there is shown the nozzle 10 of the present invention. The nozzle 10 has a body 11 divided into a rear body member 12 and a forward body member 13. The rear body member 12 has a large diameter portion 14 and a smaller diameter portion or neck 15 connected by a shoulder 16. The forward body member 13 has a large diameter portion 13 having the same diameter as the large diameter portion 14 of the rear body member 12. Extending forward from the large diameter portion 17 is a tapering portion 18 which terminates at the blunt front end 19 of the forward body member 13.

The body members 12 and 13 are attached to each other by a cylindrical tubular sleeve 20 which has threaded portions 21 and 22 on its exterior at each end. The rear threaded portion 21 of the sleeve 20 engages a corresponding interior threaded portion 23 in the rear body member 12. The forward threaded portion 22 of the sleeve 20 engages a corresponding threaded portion 24 in the interior of the forward body member 13. The large diameter portions 14 and 17 of the body members 12 and 13 fit tightly together. To ensure that the interface between the body members 12 and 13 is leakproof, a circumferential groove 25 is formed in the large diameter portion 17 of the forward body member 13 and a circumferential ring seal 26 is inserted within the groove.

Water or other fluid is supplied to the nozzle 10 through a fluid inlet 28 comprising a threaded opening 29 formed in the neck 15 of the rear body member 12. The threaded opening 29 provides a female coupling receptacle for the threaded male coupling member of a conventional flexible hose (not shown).

Fluid is expelled from the nozzle 10 through a plurality of fluid outlets comprising rear spray jets 31 and front spray jets 32. Each spray jet 31 and 32 comprises a small cylindrical head 33 having a small orifice 34 extending therethrough. As water flows through the small orifice 34, it is expelled from the head 33 at high speeds and at high pressure to form an effective jet spray. Each of the heads 33 has a threaded portion 35 which is threaded into corresponding openings 36 and 37 in the nozzle body 11. Hex portions 38 are provided on each of the heads 33 to assist in installing the heads 33 in the threaded couplings 36 or 37 in the nozzle body.

The rear spray jets 31 are mounted around the shoulder 16 of the rear body member 12 between the large diameter portion 14 and the neck 15, with each rear jet 31 projecting a rearward spray of fluid. The front spray jets 32 are mounted around the tapering portion 17 of the forward body member 13 with each front jet 32 also projecting a rearward spray of fluid. A plurality of V-shaped indentations 39 (FIGS. 1 and 2) are provided in the tapering portion 17 to provide a clearance for the rearward spray from the front spray jets 32.

Figure 1:
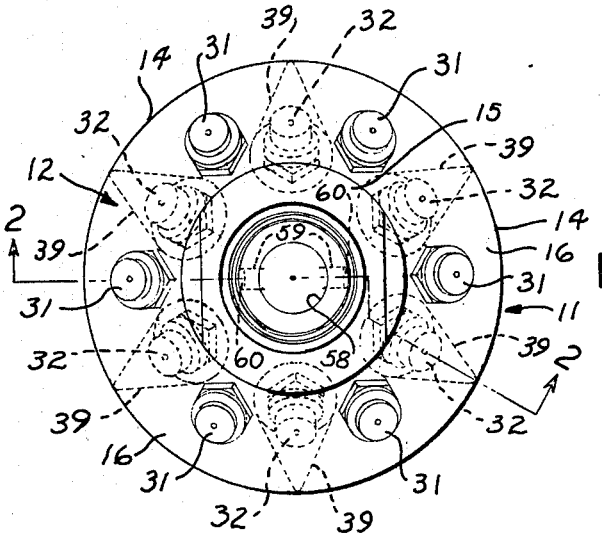
FIG. 1 is a top plan view of the pulsating nozzle of the present invention.

As shown in FIG. 1, the plurality of rear spray jets 31 and the plurality of front spray jets 32 are equally spaced angularly about the axis of the nozzle body 11. The orifice 34 of each jet 31 and 32 has an axis which includes an acute angle with the axis of the nozzle body 11 and directs the spray in a direction which is radially outward and axially rearward with respect to the axis of the body. Each set of spray jets 31 and 32 is thus uniformly distributed about the axis of the nozzle body 11 and directed symmetrically against all the walls of the waste conduit in which the nozzle is inserted.

Fluid flows from the fluid inlet 28 to the rear spray jets 31 through a path in the interior of the nozzle body 11, which path comprises a cylindrical inner chamber 40 and an annular outer chamber 41. The inner chamber 40 is formed within the tubular sleeve 20 and extends through the rear body member 12 and the forward body member 13 axially with the fluid inlet 28. The outer chamber 41 is formed in the forward body member 13 and extends annularly around the inner chamber 40. The outer chamber 41 forms a fluid reservoir in which fluid received from the hose through the inlet 28 is intermittently stored until it is expelled through the spray jets 31 in a pulsating flow in which the maximum fluid flow rate may exceed the maximum flow rate into the nozzle through the inlet. A plurality of passages 43 extend through the rear body member 12 and connect each of the threaded openings 36 with the outer chamber 41 to supply fluid to each of the rear spray jets 31.

The inner chamber 40 is separated from the outer chamber 41 by a cylindrical wall 42 formed by the central portion of the tubular sleeve 20 between the two threaded portions 21 and 22. A plurality of ports 44 extend through the cylindrical wall 42 and provide a passage by which the fluid in the inner chamber 40 flows into the outer chamber 41. In the embodiment of the invention shown in FIGS. 1–4, two ports 44 are shown. Each of the ports 44 extends through the wall 42 in a direction which is parallel to the radius of a cylindrical wall 42 but which is laterally offset from the radius.

Figure 3:
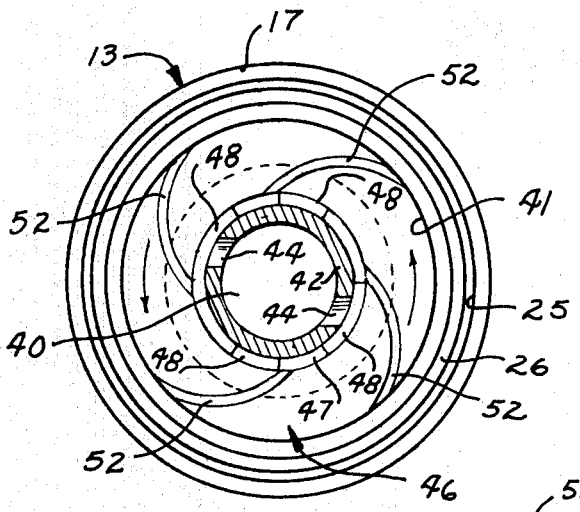
FIG. 3 is a top sectional view of the nozzle taken along line 3—3 of FIG. 2.
Figure 4:
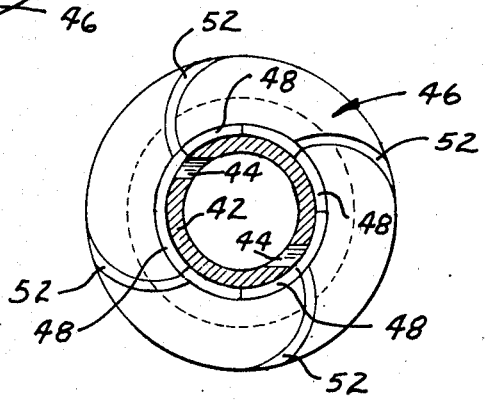
FIG. 4 is a top sectional view similar to FIG. 3 showing just the cylindrical wall and the rotor.

The pulsating effect of the flow is provided by a rotor 46 which is mounted within the outer chamber 41. As shown in FIGS. 3 and 4, the rotor 46 comprises a hub 47 having an inner diameter slightly larger than the outer diameter of the cylindrical wall 42, permitting the rotor 46 to rotate within the outer chamber 41 around the wall 42. The hub 47 extends axially along the outside of the cylindrical wall 42 to block the flow of fluid through the ports 42 in the wall. A plurality of slots or openings 48 are provided in the hub 47. Each opening 48 is positioned to intermittently coincide with one of the ports 44 as the rotor 46 turns. When one of the openings 48 coincides with one of the ports 44, the opening permits fluid to flow through the ports 44 from the inner chamber 40 to the outer chamber 41. As the rotor 46 continues to rotate, the hub 47 again blocks the flow of fluid through the port 44. This intermittent opening of the ports 44 produces the pulsating flow of fluid supplied to the rear spray jets 31.

The rotor 46 also comprises a disc-shaped base 50 having a diameter about the same as the outer chamber 41. To assist in turning the rotor 46, a plurality of roller bearings 51 may be provided between the base 50 of the rotor and the forward wall of the outer chamber 41. A plurality of blades 52 are mounted on the base 50 and extend from the hub 47 spirally outwardly from the inner periphery of the outer chamber to the outer periphery of the outer chamber. One blade 52 is provided for each of the openings 48 in the hub 47. Each blade 52 is positioned adjacent to one of the openings 48 so that, as the opening 48 coincides with one of the ports 44 in the cylindrical wall, the stream of fluid through the ports 44 and the opening 48 strikes the blade 51 to propel the blade and turn the rotor 46. Preferably, the blade 51 extends perpendicularly to the flow of fluid through the port 44 and the opening 48, so that the impulse of the fluid on the blade is maximized. In order to achieve the required impulse on the blades 52 in the proper direction to turn the rotor 46, the ports 44 are laterally offset from the radius of the cylindrical wall 42, as previously explained. The flow of fluid through the ports 44 is thus laterally offset from the radius of the rotor 46 so that when the stream of water hits the blade 52, it provides impulse in the circumferential direction to propel the rotor.

The front spray jets 32 are supplied with fluid by passages 56 (FIG. 2) which extend from the threaded opening 37 inwardly and toward the front of the body member 13. A front flow restricting member 57 is mounted in the forward body member 13 in front of the inner chamber 40 and the tubular sleeve 20. The flow restricting member 57 restricts the flow to the front spray jets 32 so that sufficient fluid pressure is maintained through the ports 44 to the outer chamber 41 and the rear spray jets 31. The member 57 has an inlet 58 which connects to the inner chamber 40 directly in front of the forward threaded portion 22 of the tubular sleeve 20. A radially extending passage 59 extends from the inlet 58 and connects with axially extending passages 60 (FIG. 1) which extend toward the front of the nozzle and connect with the passages 56.

A front spear or tip 65 may also be mounted on the front end 18 of the forward body member 13. The tip 65 may be used to spearhead the action of the nozzle as it travels through the conduit. If desired, the tip 65 may be provided with a plurality of orifices 66 which may be connected to the fluid supply in the nozzle to provide additional spray at the head of the nozzle.

Figure 5:
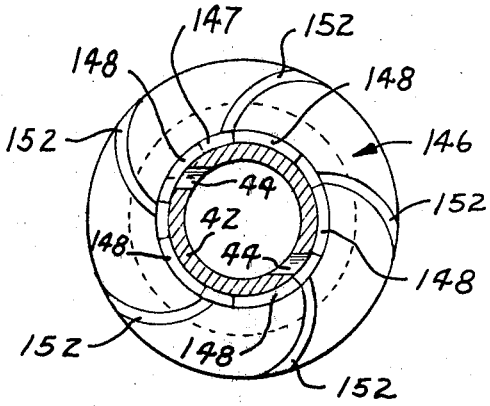
FIG. 5 is a top sectional view similar to FIG. 4 showing another embodiment of the present invention.
Figure 7:
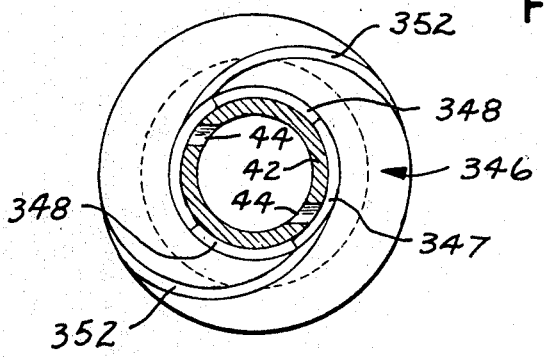
FIG. 7 is a top sectional view similar to FIGS. 4–6 showing a fourth embodiment of the present invention.
Figure 6:
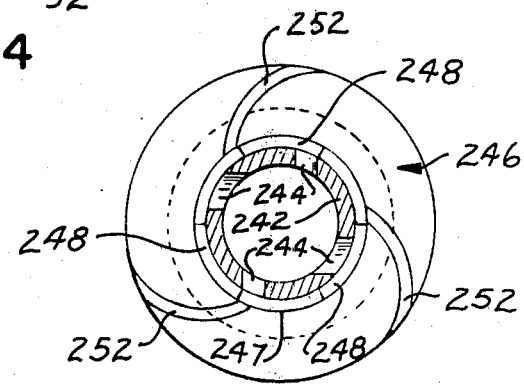
FIG. 6 is a top sectional view similar to FIGS. 4 and 5 showing a third embodiment of the present invention.

The embodiment of the present invention illustrated in FIGS. 1–4 comprises two ports 44 in the cylindrical wall 42, and four hub openings 48 and four blades 51 on the rotor 46. Additional or fewer ports, openings, and blades may also be possible. FIGS. 5, 6, and 7 show cylindrical wall and rotor assemblies having different numbers of elements.

FIG. 5 depicts the cylindrical wall 42 having two ports 44. Mounted around the wall 42 is a rotor 146 having a central hub 147 provided with five slots or openings 148. Each of the openings 148 is somewhat smaller than the corresponding openings 48 of FIG. 4. Five blades 152 are provided, each blade extending spirally from the hub 147 adjacent to one of the openings 148.

FIG. 6 shows a cylindrical wall 242 having four ports 244. Each port 244 extends through the wall 242 in a direction generally parallel to the radius of the cylindrical wall and laterally offset from the radius. A rotor 246 is mounted around the cylindrical wall 242. Because of the increased number of ports 244, it may be possible to use a rotor 246 having a hub 247 with only three openings 248 and having three blades 252.

FIG. 7 depicts the cylindrical wall 42 having two ports 44 with a rotor 346 having a hub 347 mounted around the cylindrical wall. The rotor 346 is provided with only two openings 348, each of which extends circumferentially around the hub 347 for a greater distance than the openings 48 in the rotor 46 of FIG. 4. Two blades 352 extend from the hub 347. Each of the blades 352 extends in a spiral configuration from the hub 347, with a radius which is greater than the blades 52 or 252 of FIG. 3 or 6, respectively. Thus, the hub 347 will block the flow of fluid through the ports 44 for a shorter period of time, and the flow of fluid will strike the blades 352 for a longer duration to produce the impulse which will propel the rotor 346.

Other modifications and variations of the invention are possible. For example, the front spray jet 32 may be eliminated, since the flow through these front spray jets is continuous and not pulsating. With the elimination of the front spray jets 32, the V-shaped indentations 36 provided for the spray jets may also be eliminated, so that the tapering portion 17 of the forward body member 13 would be smooth around the entire circumference of the body member. The resulting spray produced by the modified nozzle would be emitted only from the spray jets 31 and would produce a greater pulsating effect and may be more effective, depending upon the nature of the conduit in which it is used. In addition, the front tip 65 may also be eliminated.

While preferred forms of this invention have been specifically illustrated and described herein, it will be apparent to those skilled in the art that other modifications and improvements may be made to the forms herein specifically disclosed. Accordingly, the present invention is not to be limited to the forms herein specifically disclosed, or in any other way inconsistent with the progress in the art promoted by this invention.

What is claimed is:

1. A pulsating fluid nozzle which comprises:

a body having an inner chamber and an outer chamber extending around the inner chamber, the inner chamber separated from the outer chamber by a wall having a cylindrical outer shape, the body also having a fluid inlet connected to supply fluid to the inner chamber and a fluid outlet connected to receive fluid from the outer chamber, the wall having a port through which fluid can flow from the inner chamber to the outer chamber; and a rotor mounted around the wall for rotation in the outer chamber, the rotor having at least one blade extending from a hub, the hub adapted to fit against the wall and block the flow of fluid through the port in the wall, the hub having an opening adapted to intermittently coincide with the port in the wall as the rotor turns to intermittently permit the flow of fluid through the port to produce a pulsating flow, the blade adjacent to the opening and positioned to be contacted by a stream of fluid flowing through the port when the opening coincides with the port, the contact by the stream of fluid propelling the blade to turn the rotor.

2. A pulsating fluid nozzle as defined in claim 1, wherein the wall is cylindrical and the port extends in a direction generally parallel to the radius of the cylindrical wall and laterally offset from the radius.

3. A pulsating fluid nozzle as defined in claim 1, wherein the wall has a plurality of ports, the rotor has a plurality of blades extending from the hub, and the hub has a plurality of openings adapted to intermittently coincide with the ports in the wall, each blade adjacent to one of the openings and positioned to be contacted by a stream of fluid flowing through one of the ports when the adjacent opening coincides with one of the ports.

4. A pulsating fluid nozzle as defined in claim 1, wherein the fluid outlet comprises a plurality of spray jets directing a fluid flow in a rearward direction.

5. A pulsating fluid nozzle as defined in claim 1, wherein the blade extends from the hub across the outer chamber to divide the outer chamber into separate portions.

6. A pulsating fluid nozzle as defined in claim 1, wherein the blade extends from the hub in a spiral configuration.

7. A pulsating fluid nozzle which comprises:

a body having an inner chamber and an annular outer chamber extending around the inner chamber, the inner chamber separated from the outer chamber by a cylindrical wall, the body also having a fluid inlet connected to supply fluid to the inner chamber and a plurality of spray jets each connected to receive fluid from the outer chamber, each of the spray jets directing a spray of fluid in a rearward direction, the cylindrical wall having a plurality of ports through which fluid can flow from the inner chamber to the outer chamber, each port extending in a direction generally parallel to the radius of the cylindrical wall and laterally spaced from the radius; and a rotor mounted around the wall for rotation in the outer chamber, the rotor having a plurality of blades extending from an annular hub, the hub adapted to fit around the cylindrical wall and block the flow of fluid through the ports in the wall, the hub having a plurality of openings adapted to intermittently coincide with the ports in the wall as the rotor turns to intermittently permit the flow of fluid through the ports to produce a pulsating flow, each blade extending from the hub across the outer chamber to divide the outer chamber into separate portions, each blade adjacent to one of the openings and positioned to be contacted by a stream of fluid flowing through one of the ports when the adjacent opening coincides with one of the ports, the contact by the stream of fluid propelling the blade to turn the rotor.

* * * * *